US007281280B2

(12) United States Patent
Lahay

(10) Patent No.: US 7,281,280 B2
(45) Date of Patent: Oct. 16, 2007

(54) SPA COVER REMOVING DEVICE

(76) Inventor: Leon Lahay, 3939-244 Street, RR #3, Langley, British Columbia (CA) V2Z 2M1

( * ) Notice: Subject to any disclaimer, the term of this patent is extended or adjusted under 35 U.S.C. 154(b) by 363 days.

(21) Appl. No.: 11/046,788

(22) Filed: Feb. 1, 2005

(65) Prior Publication Data

US 2005/0125888 A1 Jun. 16, 2005

Related U.S. Application Data

(63) Continuation-in-part of application No. 10/347,263, filed on Jan. 21, 2003, now abandoned.

(51) Int. Cl.
*E04H 4/06* (2006.01)

(52) U.S. Cl. ..... 4/498

(58) Field of Classification Search ..... 4/498
See application file for complete search history.

(56) References Cited

U.S. PATENT DOCUMENTS

| | | | | |
|---|---|---|---|---|
| 4,576,505 | A | 3/1986 | Wrightson et al. | 403/362 |
| 5,048,153 | A | 9/1991 | Wall et al. | 4/498 X |
| 5,131,102 | A | 7/1992 | Salley et al. | 4/498 |
| 5,634,218 | A | 6/1997 | Ouelette | 4/498 |
| 5,974,599 | A | 11/1999 | Tudor | 4/498 |
| 6,000,071 | A | 12/1999 | Fettes | 4/498 |
| 6,000,072 | A | 12/1999 | LaHay | 4/498 |
| 6,032,305 | A | 3/2000 | Tedrick | 4/498 |
| 6,634,036 | B2 * | 10/2003 | Tudor | 4/498 |
| 6,742,196 | B2 * | 6/2004 | LaHay | 4/498 |
| 6,795,984 | B1 * | 9/2004 | Brady | 4/498 |

* cited by examiner

*Primary Examiner*—Robert M. Fetsuga
(74) *Attorney, Agent, or Firm*—Cameron IP

(57) ABSTRACT

A spa cover removing device has improved rigidity and includes cross pieces that fit into elongate sleeves provided at each end of a center hinge between two half sections of a spa cover. The removing device has a substantially rigid frame with a pair of parallel side bars positioned on opposing sides of the spa housing, the side bars have upper ends rigidly attached to upper elbow pieces projecting toward each other, each elbow piece rigidly joined to retainer bars to extend across the center hinge of the spa cover and support the spa cover. The side bars of the rigid frame also have lower ends rigidly attached to lower elbow pieces connected to a single square tubular pivot shaft extending across the spa housing, and the pivot shaft is supported in annular supports at the opposite sides of the spa housing, these annular supports each have an internal diameter sufficient for the pivot shaft of the rigid frame to pivot therein and hence remove the spa cover.

16 Claims, 10 Drawing Sheets

FIG 4-A

SPA COVER REMOVING DEVICE

CROSS-REFERENCE TO RELATED APPLICATION

This application is a continuation-in-part application of U.S. patent application Ser. No. 10/347,263 filed Jan. 21, 2003, now abandoned.

BACKGROUND OF THE INVENTION

1. Field of the Invention

The present invention relates to a cover removing device for a spa, and more particularly to a spa cover removing device for a spa cover formed of two half sections joined by a center hinge.

2. Description of the Related Art

Outdoor spas, previously known as hot tubs, generally have an insulated cover to retain the heat of the water in the spa. The cover also keeps the water clean and prevents leaves and other foreign objects from dropping into the water.

Spa covers are usually made with a filling of insulating material generally with a plastic cover sheet, e.g. a vinyl cover sheet. Most spa covers are made in two halves with a center hinge such that the covers can be folded in half to facilitate easy removal from their spas.

In U.S. Pat. No. 5,634,218, issued Jun. 3, 1997 to Ouelette, there is disclosed a lifting frame for a spa cover which has opposing supports extending along a cover hinge for the cover to fold over and thus be removed. It has been found that continual use of a frame such as that disclosed in this patent sometimes causes wear to occur on the vinyl surface of the cover where it contacts the frame.

In my U.S. Pat. No. 6,000,072, issued Dec. 14, 1999, I disclosed a spa cover removing device having a pair of parallel side bars pivotally connected at their lower ends to opposite sides of the spa. From experience with the use of such a spa cover removing device, it has been found that there are some cases when this spa cover removing device does not have sufficient rigidity.

In my co-pending U.S. patent application Ser. No. 10/093,064 I have disclosed a more rigid frame and also a tube over the cross bar which rotates as the cover is being folded over and raised. This reduces wear on the vinyl surface of the cover.

BRIEF SUMMARY OF THE INVENTION

According to one aspect of the present invention, there is provided in combination a spa cover and a spa cover removing device. The spa cover comprises two half sections and a center hinge between the half sections. In addition, the spa cover further comprises first and second sleeves located opposite each other along the hinge.

The spa cover removing device comprises a frame which comprises a pair of parallel side bars that have upper and lower ends. The pair of parallel side bars are for location at opposite sides of a spa housing. The frame further comprises upper elbow pieces rigidly attached to the upper ends, first and second retainer bars extending towards one another from respective ones of the upper elbow pieces, lower elbow pieces attached to the lower ends and a pivot shaft that extends between the lower end pieces.

The spa cover removing device further comprises first and second tubes received in respective ones of first and second sleeves, and bearings for pivotally supporting the pivot shaft in opposite sides of the spa housing. The first and second tubes rotatably receive the first and second retainer bars therein.

In another aspect of the present invention, there is provided in combination a spa cover and a spa cover removing device. The spa cover comprises two half sections, a center hinge between the half sections and a sleeve extending along the hinge.

The spa cover removing device comprises a frame which comprises a pair of parallel side bars for location at opposite sides of a spa housing. The pair of parallel side bars have upper and lower ends. The frame further comprises upper elbow pieces rigidly attached to the upper ends, a retainer bar extending between the upper elbow pieces along the interior of the sleeve, lower elbow pieces attached to the lower ends and a pivot shaft extending between the lower end pieces.

The spa cover removing device further comprises a tube received in the sleeve. The tube rotatably receives the retainer bar therein.

In a further aspect of the present invention, there is provided in combination a spa housing, a spa cover and a spa cover removing device. The spa cover comprises two half sections, a center hinge between the half sections and an elongate sleeve along the hinge.

The spa cover removing device comprises a frame which comprises a pair of parallel side bars for location at opposite sides of a spa housing. The pair of parallel side bars have upper and lower ends. The frame further comprises upper elbow pieces rigidly attached to the upper ends, a retainer bar extending between the upper elbow pieces along the interior of the sleeve, lower elbow pieces attached to the lower ends and a pivot shaft extending between the lower end pieces through the spa housing.

BRIEF DESCRIPTION OF THE DRAWINGS

The present invention will be more readily understood from the following description of a preferred embodiment thereof given, by way of example, with reference to the accompanying drawings, in which:

FIG. 4A shows a partial cross-sectional view of a cover hinge and an elongate sleeve at line 4-4 of FIG. 1;

DESCRIPTION OF THE PREFERRED EMBODIMENT

Figure 1:
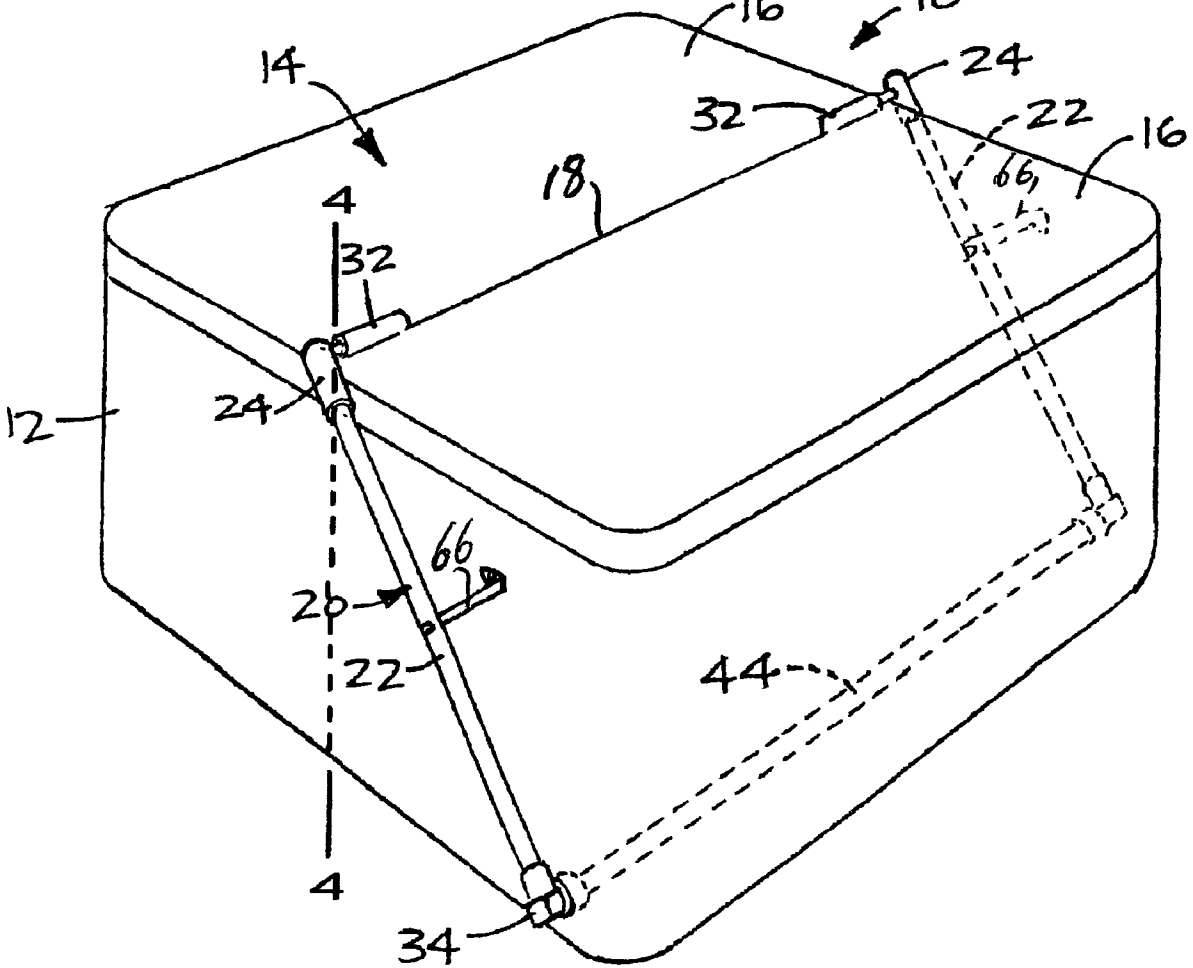
FIG. 1 shows a perspective view of spa provided with a spa cover removing device according to a first embodiment of the present invention.
Figure 2:
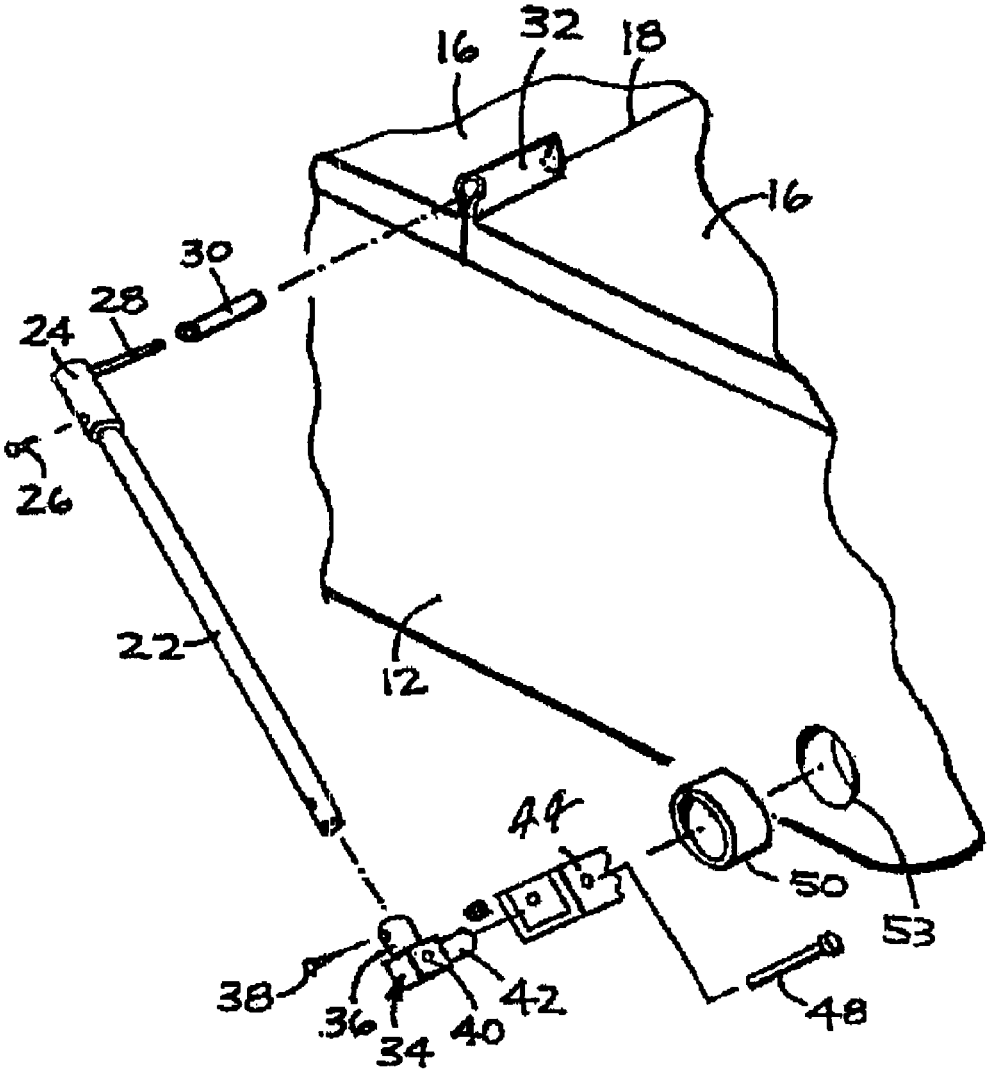
FIG. 2 shows a broken away perspective view of parts of the spa cover removing device according to FIG. 1.

As shown in FIG. 1, a spa indicated generally by reference numeral 10 has a housing 12 with a cover indicated generally by reference numeral 14 on top thereof. The cover 14 is formed in two half sections 16 with a center hinge 18 so that one half section 16 of the cover 14 may be folded over the other half section 16 prior to removing the cover from the spa housing 12. The spa cover removing device 20 has two side bars 22 as shown more clearly in FIG. 2 and at the top end of the side bars 22 are upper elbow pieces 24 which are rigidly joined to the side bars 22 by bolts or pins 26 (FIG. 2). The upper elbow pieces 24 have retainer bars 28 extending at right angles therefrom toward each other. The retainer bars 28 pass through tubes 30, preferably made of metal, although they may be made of a suitable plastic material, which in turn fit into sleeves 32 integrally formed at each end of the center hinge 18. The upper elbow pieces 24 provide a rigid connection between the retainer bars 28 and the side bars 22 and the tubes 30 can rotate on the retainer bars 28 to reduce friction on the cover 14 that might otherwise occur when the half sections 16 of the cover 14 are being folded.

The sleeves 32, as can be seen in FIG. 2, are formed at opposite ends of the center hinge 18 and are provided so that when one half section 16 is folded over the other half section 16, the sleeves 32 still contain the retainer bars 28.

The lower ends of the side bars 22 are provided with respective lower elbow pieces 34, of which each has a tubular top section 36 into which the lower end of the respective side bar 22 fits snugly and is attached by a pin or screw 38. A bottom portion 40 of each lower elbow piece 34 has a substantially square cross-section and has a cylindrical projection 42 which extends horizontally toward the lower elbow piece 34 on the opposite side of the spa housing 12.

Opposite ends of a square tubular pivot shaft 44 are attached rigidly to the lower elbow pieces 34. It has been found that square tubular pivot shafts tend to resist torque better than a round tubular pivot shaft and twists less for the same size of shaft. The bottom portions 40 fit snugly into opposite ends of the square tubular pivot shaft 44 and are held in place by pins or nuts and bolts 48. Thus, the connections between the pair of parallel side bars 22 and the pivot shaft 44 are rigid and resistant to torque if and when one of the two side bars 22 is raised by hand, thus facilitating removal of the cover 14.

The pivot shaft 44 is supported in annular bearings in the form of plastic tube sections or supports 50 in the opposite sides of the spa housing 12. These supports 50 have a diameter sufficient to permit the square tubular pivot shaft 44 to be easily rotated within them and yet retain the pivot shaft 44 in the desired location. Each of the annular supports 50 fits into a hole 53 in the respective side of the spa housing 12.

Figure 4B:
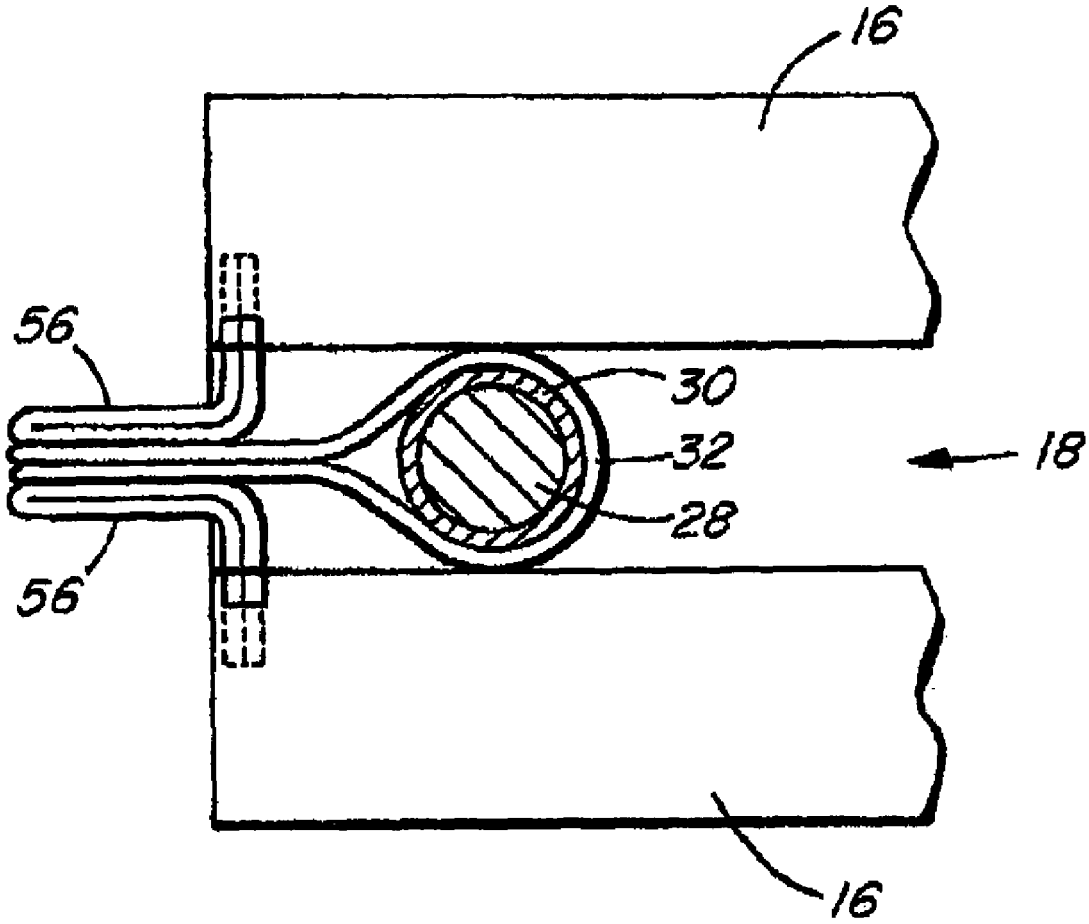
FIG. 4B shows the cover hinge of FIG. 4A with one half section of the cover folded over the other half section.

A detail of the center hinge 18 of FIG. 1 and is shown in FIGS. 4A and 4B joining the two half sections 16 together. The hinge 18 has flexible plastic strips 56 connected to the half cover sections 16 to hold the sleeve 32 therebetween. FIG. 4A shows the half cover sections 16 in the open position across the spa housing 12 as shown in FIG. 1. The flexible plastic strips 56 straighten when one half section is folded over the other half section as shown in FIG. 4B which holds the sleeve 32 in place. The tube 30 is shown between the sleeve 32 and the retainer bar 28.

Figure 5:
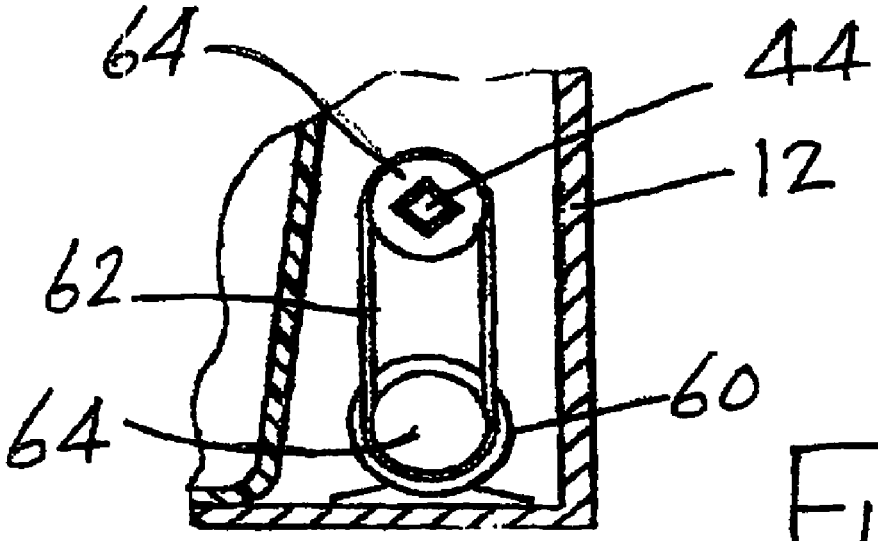
FIG. 5 shows a partial cross-sectional view of a motor attached to a pivot shaft in the device of FIG. 1.
Figure 5A:
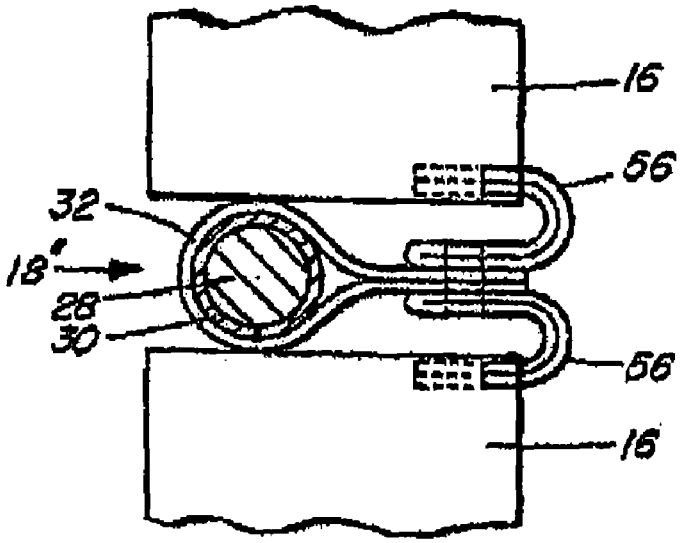
FIG. 5A shows a partial cross-sectional view of another embodiment of a cover hinge to that shown in FIGS. 4A and 4B.
Figure 5B:
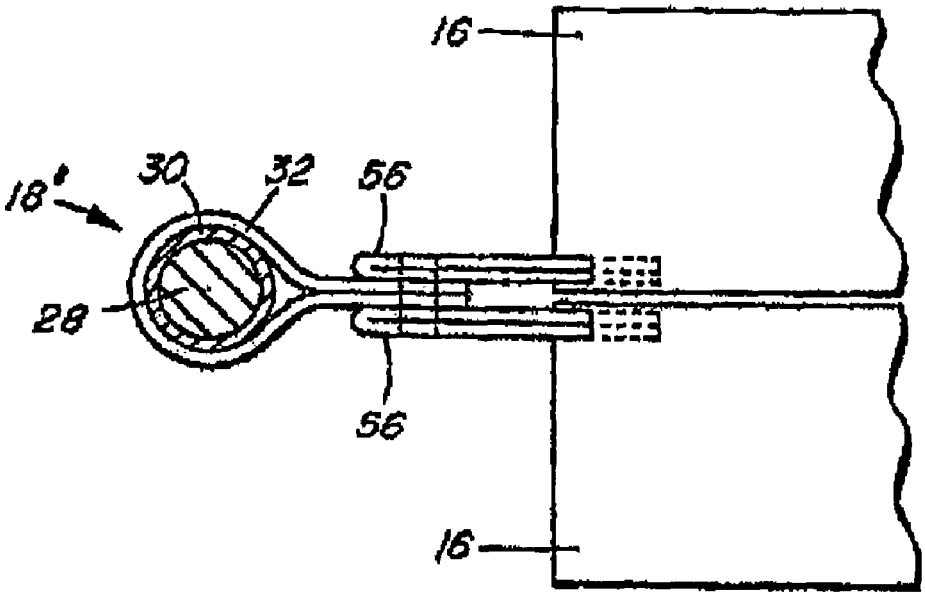
FIG. 5B shows the cover hinge of FIG. 5A with one half section of the cover folded over the other half section.

Another embodiment of a center hinge 18' is shown in FIGS. 5A and 5B. In this embodiment, the hinge 18' is placed between the two half cover sections 16 when they are in the open position across the spa housing 12 as shown in FIG. 1. This is illustrated in FIG. 5A. When one half cover section 16 is folded over the other half cover section 16, as shown in FIG. 5B, the hinge 18' remains outside the half cover sections 16 which avoids any space between the folded half cover sections. The arrangement of retainer bar 28, tube 30 and sleeve 32 remains the same, only the flexible plastic straps 56 are reversed from the embodiment shown in FIGS. 4A and 4B.

Figure 3:
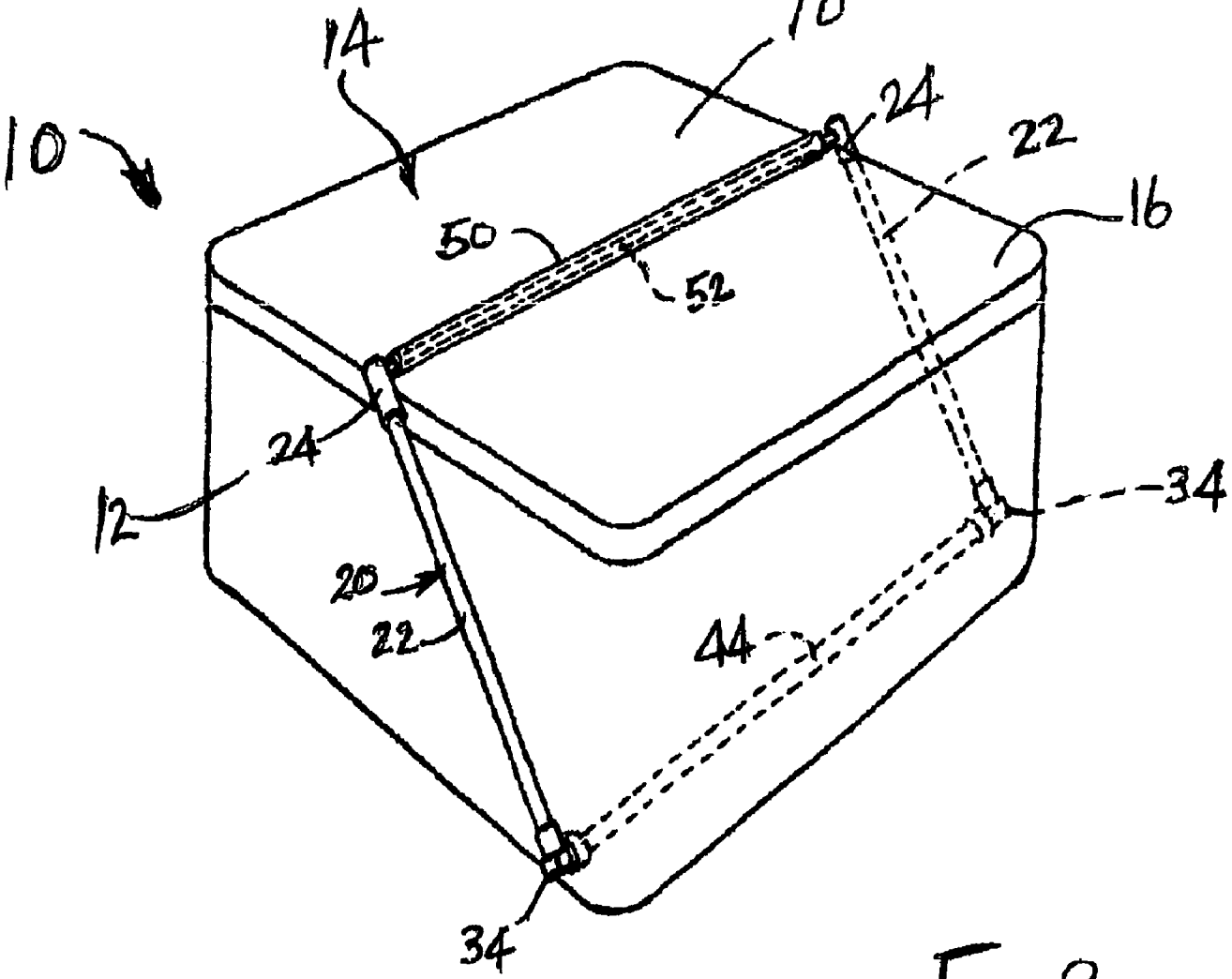
FIG. 3 shows a perspective view of a spa provided with a spa cover removing device according to another embodiment of the present invention.
Figure 6:
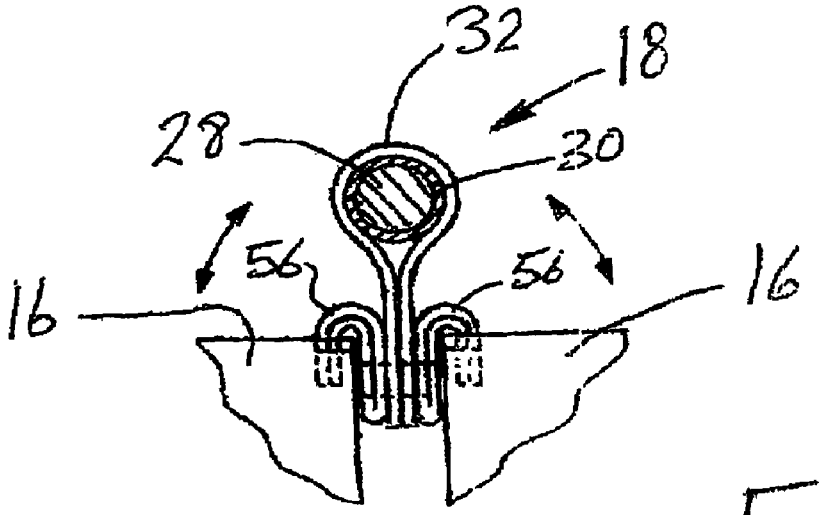
FIG. 6 shows a partial cross-section through a corner of a spa housing with a drive motor for the cross-shaft according to a further embodiment of the present invention.
Figure 6:
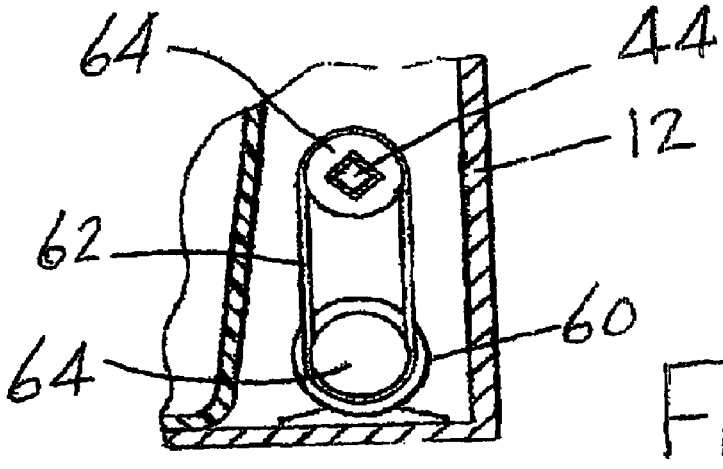

FIG. 3 shows another embodiment of the invention in the form of a modification of the apparatus of FIGS. 1 and 2, in which a single elongate sleeve 50 extends across the cover 14 at the center hinge 18. A single retainer bar 52 extends through the sleeve 50 between the two upper elbow pieces 24 on opposite sides of the housing 12.

The square tubular pivot shaft 44 of FIG. 2 may be rotated by a motor 60 as shown in FIG. 5. The pivot shaft has a belt or chain drive 62 between two pulley wheels or sprockets 64. Such a mechanism avoids the necessity of a person having to manually raise or lower the spa cover removing device.

Springs in the form of elastic cables or bungee cords 66 are connected at opposite ends thereof to the side bars 22 and the respective sides of the spa housing 12 to assist in removing the spa cover 14 in the manner disclosed in greater detail in my co-pending U.S. patent application Ser. No. 10/093,064, the disclosure of which is incorporated herein by reference.

Figure 7:
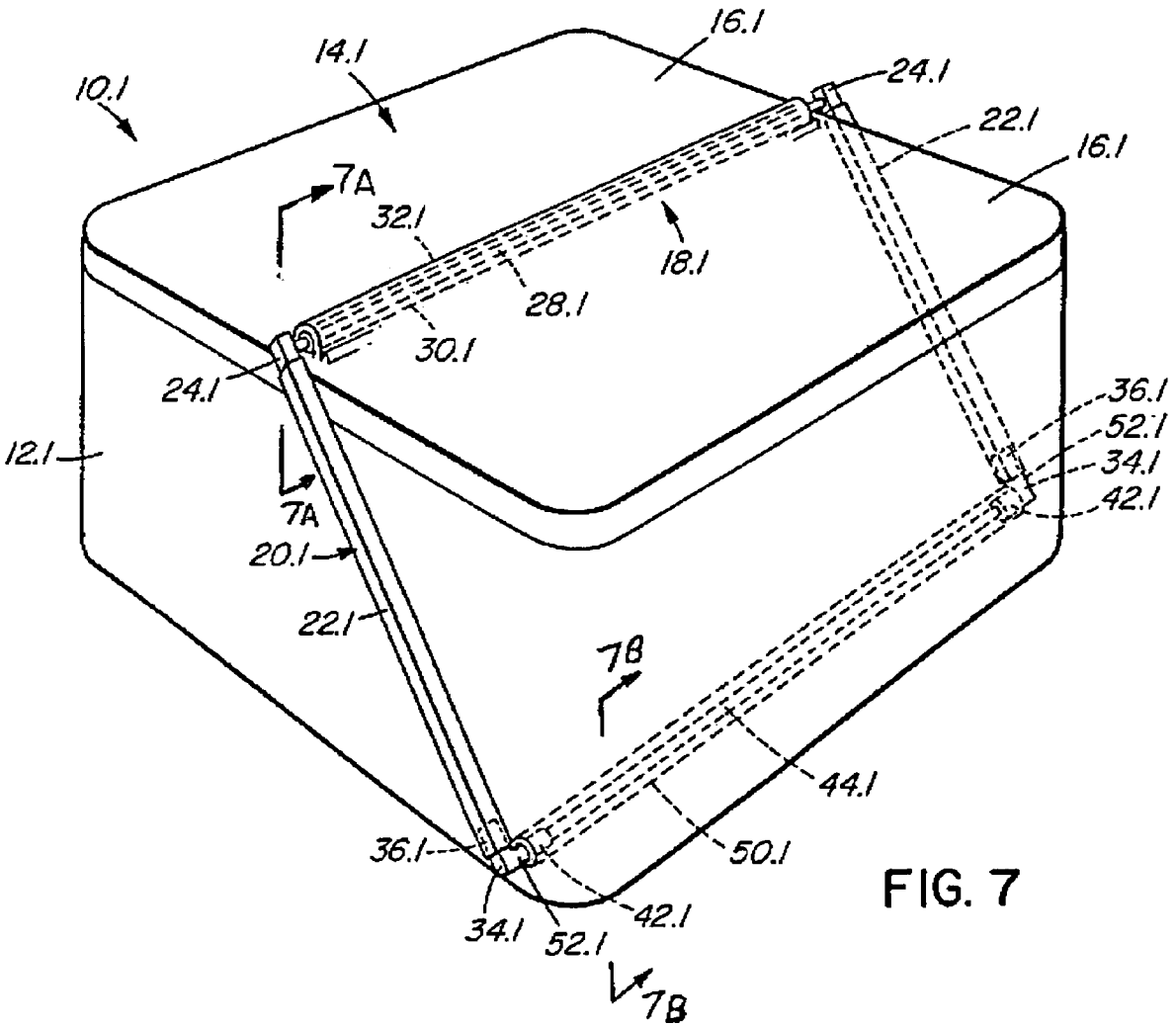
FIG. 7 shows a perspective view of a spa provided with a spa cover removing device according to another embodiment of the present invention.

Another embodiment of the invention is illustrated in FIG. 7 wherein parts corresponding to those of FIGS. 1 and 2 have been indicated by like reference numerals with an additional suffix ".1". A spa indicated generally by reference numeral 10.1 has a housing 12.1 with a cover indicated generally by reference numeral 14.1 on top thereof. The cover 14.1 is formed in two half sections 16.1 with a center hinge indicated by reference numeral 18.1 so that one half section 16.1 of the cover 14.1 may be folded over the other half section 16.1 prior to removing the cover from the spa housing 12.1.

The spa cover removing device 20.1 has two side bars 22.1 and at the top end of the side bars are upper elbow pieces 24.1 which are rigidly joined to the side bars. The side bars 22.1 are of square cross section in this example, but could be other types of bars.

Figure 7A:
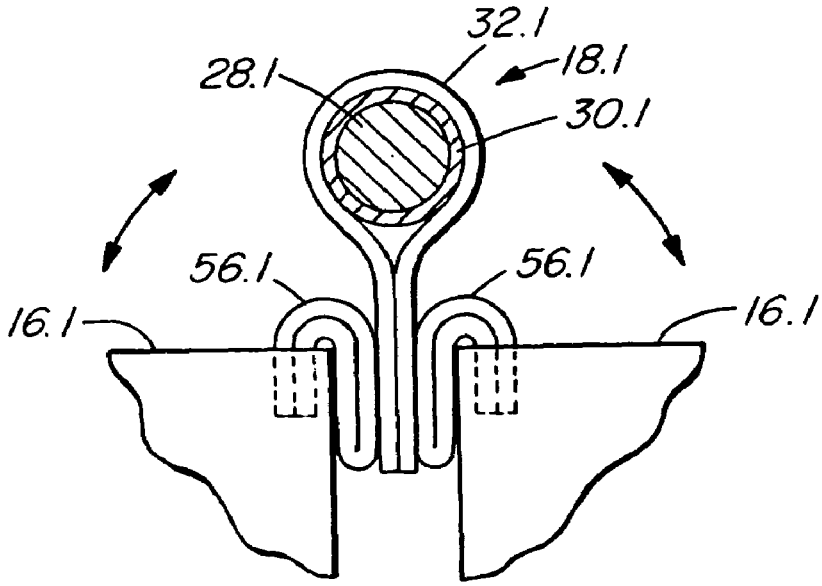
FIG. 7A shows a partial cross-sectional view of a cover hinge and an elongate sleeve at line 7A,B-7A,B of FIG. 7.

The center hinge includes a retainer bar 28.1 and a tube 30.1 which both extend through a sleeve 32.1. The retainer bar 28.1 extends at right angles to the side bars 22.1 from one to the other of the upper elbow pieces 24.1. The retainer bar 28.1 passes through the tube 30.1, as further illustrated in FIG. 7A. The tube 30.1 is preferably made of metal, although may be made of a suitable plastic material.

The upper elbow pieces 24.1 provide a rigid connection between the retainer bar 28.1 and the side bars 22.1, the tube 30.1 being rotatable on the retainer bar to reduce friction on the sleeve 32.1 of the cover 14.1 that might otherwise occur when the half sections 16.1 of the cover are being folded.

The sleeve 32.1 is provided so that, when one half section 16.1 is folded over the other half section 16.1, the sleeve still remains and contains the retainer bar 28.1.

The lower ends of the side bars 22.1 are provided with respective lower elbow pieces 34.1, each having a square top section 36.1 onto which the lower end of the respective side bar fits snugly and is attached by a pin or screw (not shown). A bottom portion 42.1 of each lower elbow piece 34.1 has a substantially tubular cross-section which extends horizontally toward the respective lower elbow piece on the opposite side of the spa housing 12.1.

Opposite ends of the tubular pivot shaft 44.1 fit snugly into respective tubular cross-secitons of the bottom portions 42.1 of the lower elbow pieces 34.1 and are held in place by pins or nuts and bolts (not shown). Thus, the connections between the pair of parallel side bars 22.1 and the pivot shaft 44.1 are rigid and resistant to torque if and when one of the two side bars 22.1 is raised by hand, thus facilitating removal of the cover 14.1.

The pivot shaft 44.1 is supported in an elongate hollow bearing in the form of a plastic tube 50.1 extending between opposite sides of the spa housing 12.1. This plastic tube 50.1 has a diameter sufficient to permit the tubular pivot shaft 44.1 to be easily rotated within and yet retain the pivot shaft 44.1 in the desired location. Each end of the plastic tube 50.1 fits into a hole 53.1 in the respective side of the spa housing 12.1.

Figure 7B:
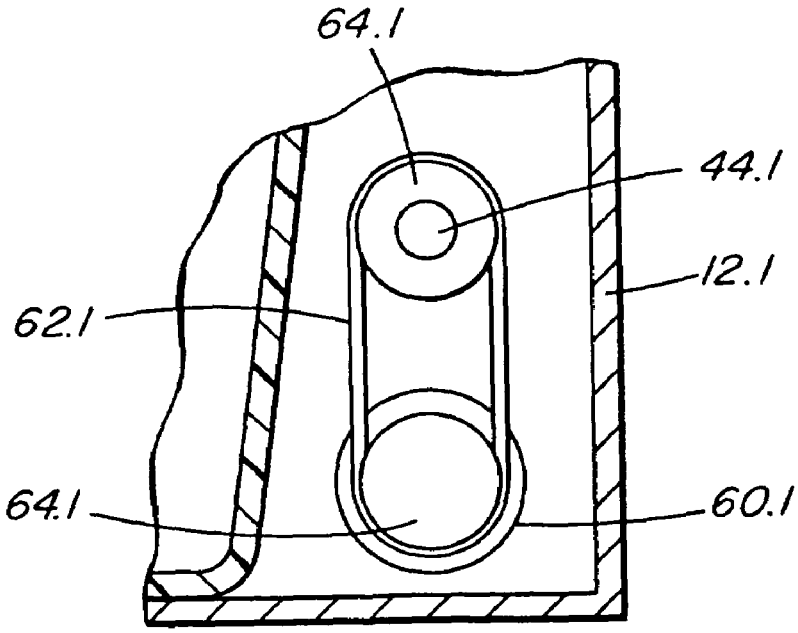
FIG. 7B shows a partial cross-sectional view of a motor attached to a pivot shaft at line 7A,B-7A,B of FIG. 7.

The tubular pivot shaft 44.1 may be rotated by a motor 60.1 as shown in FIG. 7B. The pivot shaft 44.1 has a belt or chain drive 62.1 between two pulley wheels or sprockets 64.1. Such a mechanism avoids the necessity of a person having to manually raise or lower the spa cover removing device.

Having an integrated lower bar, i.e. the pivot shaft 44.1 and plastic tube 50.1 extending through the spa, has several advantages. It does not require any mounting brackets external to the spa and therefore requires less labour to install than conventional spa cover removing devices. It can be incorporated into the original equipment of spa manufacturers instead of being offered as an after market product. This reduces the overall cost for spa having a spa cover removing device incorporated therein.

Another advantage of the integrated lower bar is a very strong fastening point for the support arms 22.1 due to the integration of the plastic tube 50.1 in the spa housing 12.1.

Figure 8:
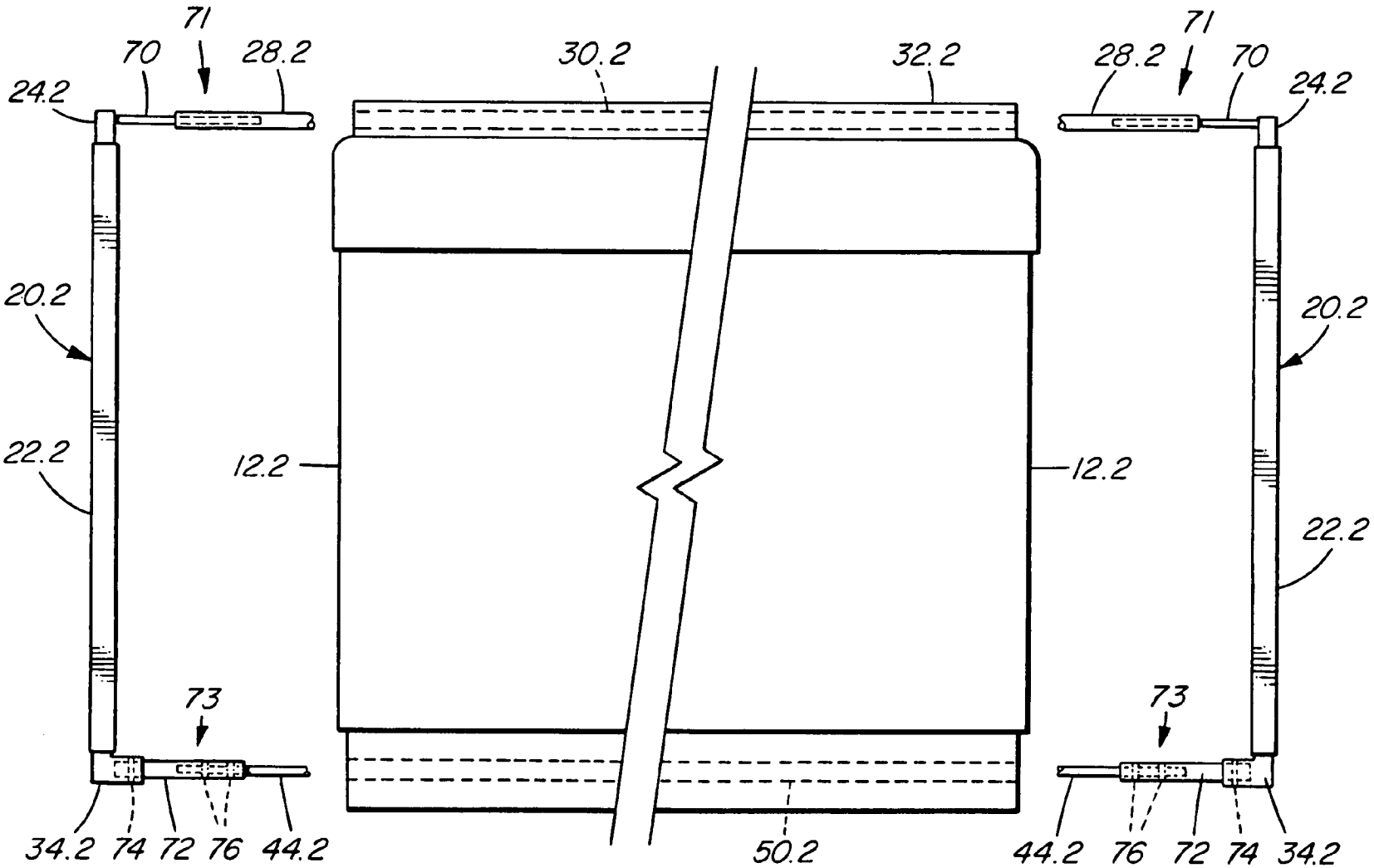
FIG. 8 shows an elevational view of a spa provided with a spa cover removing device according to a still further embodiment of the present invention.

Another embodiment of the invention is illustrated in FIG. 8 wherein parts corresponding to those of FIGS. 1 and 2 are indicated by like reference numerals with an additional suffix ".2". This embodiment is similar to the embodiment of FIGS. 7, 7A and 7B with the addition of telescoping upper and lower retainer bars 71 and 73 respectively, that extend from the side bars 22.1.

The upper retainer bar 71 comprises a pair of stub bars 70 extending from respective upper elbow pieces 24.2 towards each other, and a retainer sleeve 28.2 which telescopically engages with the pair of stub bars and secures to the stub bars by pins or nuts and bolts (not shown). The retainer sleeve 28.2 is received within a sleeve 32.2, which is similar to the sleeves 32 and 32.1. Note that this telescoping arrangement of stub bars 70 and retainer sleeve 28.2 can be reversed, i.e. the stub bars 70 can be stub sleeves, and the retainer sleeve 28.2 can be a retainer bar instead.

The lower retainer bar 73 comprises a pair of stub sleeves 72 extending from respective lower elbow pieces 34.2 towards each other, and an elongate retainer bar 44.2 telescopically engaged in the pair of stub sleeves 72 and secured thereto by pins or nuts and bolts (not shown). The lower retainer bar is received within a plastic tube 50.2 which extends between the spa housing walls (not shown). Note that this telescoping arrangement of stub sleeves 72 and elongate retainer bar 44.2 can be reversed, i.e. the stub sleeves 72 can be stub bars, and the elongate retainer bar 44.2 can be a retainer sleeve instead.

It should be understood by those skilled in the art that the various modifications of the mechanisms described heretofore are also within the scope the present invention. For instance, the retainer bars 28 and associated elements of FIGS. 1 and 2 could be combined with the single pivot bar 44.1 of FIG. 7 in another embodiment of the present invention.

What is claimed is:

1. In combination, a spa cover and a spa cover removing device; said spa cover comprising two half sections, a center hinge between said half sections and a sleeve extending along said hinge; and said spa cover removing device comprising: a frame; said frame comprising a pair of parallel side bars for location at opposite sides of a spa housing and having upper and lower ends, upper elbow pieces rigidly attached to said upper ends, a retainer bar extending between said upper elbow pieces along the interior of said sleeve, lower elbow pieces attached to said lower ends and a pivot shaft extending between said lower end pieces; and a tube received in said sleeve, said tube rotatably receiving said retainer bar therein.

2. The combination according to claim 1, wherein said tube comprises a plastic tube to reduce frictional wear when said spa cover is raised from its spa.

3. The combination according to claim 1, wherein said pivot shaft is a tubular shaft and including a tubular bearing pivotally supporting said pivot shaft and having an internal diameter sufficient for said pivot shaft to rotate therein.

4. The combination according to claim 3, wherein each of said lower elbow pieces has a substantially tubular cross-section that engages snugly with said pivot shaft to prevent relative rotational movement between said lower elbow pieces and said pivot shaft.

5. The combination as claimed in claim 1, wherein the retainer bar comprises: a pair of stub sleeves extending from the upper elbow pieces towards each other at right angles to the side bars; and a bar telescopically engagable with the pair of stub sleeves.

6. The combination as claimed in claim 1, wherein the retainer bar comprises: a pair of stub bars extending from the upper elbow pieces towards each other at right angles to the side bars; and a retainer sleeve telescopically engagable with the pair of stub bars.

7. The combination as claimed in claim 1, wherein the pivot shaft comprises: a pair of stub sleeves extending from the lower elbow pieces towards each other at right angles to the side bars; and a bar telescopically engagable with the pair of stub sleeves.

8. The combination as claimed in claim 1, wherein the pivot shaft comprises: a pair of stub bars extending from the lower elbow pieces towards each other at right angles to the side bars; and a retainer sleeve telescopically engagable with the pair of stub bars.

9. In combination, a spa cover and a spa cover removing device; said spa cover comprising two half sections, a center hinge between said half sections and first and second sleeves located opposite each other along said hinge; and said spa cover removing device comprising: a frame; said frame comprising a pair of parallel side bars for location at opposite sides of a spa housing and having upper and lower ends, upper elbow pieces rigidly attached to said upper ends, first and second retainer bars extending towards one another from respective ones of said upper elbow pieces, lower elbow pieces attached to said lower ends and a pivot shaft extending between said lower end pieces; and first and second tubes received in respective ones of first and second sleeves, said first and second tubes rotatably receiving said first and second retainer bars therein; and bearings for pivotally supporting said pivot shaft in opposite sides of said spa housing.

10. The combination according to claim 9, wherein said tubes comprise plastic tubes to reduce frictional wear when said spa cover is raised from its spa.

11. The combination according to claim 9, wherein said single pivot shaft is a tubular shaft of square cross-section and wherein said bearings are annular supports each having an internal diameter sufficient for said pivot shaft to rotate therein.

12. The combination according to claim 11, wherein each of said lower elbow pieces has a substantially square cross-section that engages snugly with said pivot shaft to prevent relative rotational movement between said lower elbow pieces and said pivot shaft.

13. In combination, a spa housing, a spa cover and spa cover removing device; said spa cover comprising two half sections, a center hinge between said half sections and an elongate sleeve along said hinge; and said spa cover removing device comprising: a frame; said frame comprising a pair parallel side bars for location at opposite sides of a spa housing and having upper and lower ends, upper elbow pieces rigidly attached to said upper ends, a retainer bar extending between said upper elbow pieces along the interior of said sleeve, lower elbow pieces attached to said lower ends and a pivot shaft extending between said lower end pieces through said spa housing, a tube received in said sleeve, said tube rotatably receiving said retainer bar therein; and a bearing for pivotally supporting said pivot shaft.

14. The combination according to claim 13, wherein said tube comprises a plastic tube to reduce frictional wear when said spa cover is removed from its spa.

15. The combination according to claim 13, wherein said pivot shaft is a tubular shaft and wherein said bearing is tubular and has an internal diameter sufficient for said pivot shaft to rotate therein.

16. The combination according to claim 15, wherein each of said lower elbow pieces has a substantially tubular cross-section that fits snugly within said pivot shaft to prevent relative rotational movement between said lower elbow pieces and said pivot shaft.

* * * * *